US005635657A

United States Patent [19]

Lee et al.

[11] Patent Number: 5,635,657

[45] Date of Patent: Jun. 3, 1997

[54] RECORDING MEDIUM FOR VIDEO-SONG ACCOMPANIMENT AND VIDEO-SONG ACCOMPANIMENT APPARATUS ADOPTING THE SAME

[75] Inventors: Deok-hyun Lee, Seoul; Dong-jin Park, Suwon, both of Rep. of Korea

[73] Assignee: Samsung Electronics Co., Ltd., Kyungki-do, Rep. of Korea

[21] Appl. No.: 456,722

[22] Filed: Jun. 1, 1995

[30] Foreign Application Priority Data

Jun. 22, 1994 [KR] Rep. of Korea ..... 94-14322

[51] Int. Cl.[6] ..... G09B 15/02; G10H 1/36

[52] U.S. Cl. ..... 84/610; 84/477 R; 434/307 A

[58] Field of Search ..... 84/609–614, 634–638, 84/477 R, 478; 358/341, 343; 348/468; 434/307 A

[56] References Cited

U.S. PATENT DOCUMENTS 5,130,816 7/1992 Yoshio ..... 358/341

5,493,339 2/1996 Birch et al. ..... 348/468 X

OTHER PUBLICATIONS

Ex parte S (Board of Appeals) Aug. 4, 1943 (Case No. 109), 25 *Journal of the Patent Office Society* 904.

*Primary Examiner*—Stanley J. Witkowski

*Attorney, Agent, or Firm*—Sughrue, Mion, Zinn, Macpeak & Seas

[57] ABSTRACT

A recording medium records multilingually written lyrics data along with accompaniment data corresponding thereto, and a video-song accompaniment apparatus adopts the recording medium. The lyrics data is written in each language by having a font look-up table made up of lyrics encoded by an index code and character image data corresponding to the index code. The recording medium can be used commonly in various countries and in countries where multiple languages are spoken, by providing multilingually written lyrics data for one song program.

2 Claims, 3 Drawing Sheets

FIG. 3A 00 08 0C 03 06 03 0A 03
07 02 03 09 00 08 0C 03
06 03 0A 08 06 03 01 03
0C 03 09 05 03 0A 06 03
05 08

FIG. 3B

| 00 | 01 | 02 | 03 | 04 | 05 | 06 | 07 | 08 | 09 | 0A | 0B | 0C |
|---|---|---|---|---|---|---|---|---|---|---|---|---|
| L | N | d | e | g | i | m | n | o | r | t | u | v |

FIG. 3C

Love me tender
Love me true
Never let me go

RECORDING MEDIUM FOR VIDEO-SONG ACCOMPANIMENT AND VIDEO-SONG ACCOMPANIMENT APPARATUS ADOPTING THE SAME

BACKGROUND OF THE INVENTION

The present invention relates to a video-song accompaniment apparatus providing lyrics together with an accompaniment signal, and more particularly, to a recording medium having multilingually written lyrics data, and to a video-song accompaniment apparatus adopting the same.

A video-song accompaniment apparatus, commonly called a karaoke system, displays song lyrics on an image output device according to an accompaniment signal. A user of this system can enjoy singing in time with the accompaniment while viewing the displayed song lyrics.

An internationally popular song is often translated into many languages. The user of a video-song accompaniment apparatus ordinarily enjoys singing the song in his/her own language but may wish to sing it in another language. Hence, the video-song accompaniment apparatus should be able to reproduce either translated lyrics or lyrics of the song's original language, according to the user's taste. Also, from the viewpoint of the producer of a song program, it is commercially practical if one song program can be used in many countries.

However, a conventional recording medium for storing a song program cannot meet the above needs because it records only monolingually written lyrics data.

SUMMARY OF THE INVENTION

To solve the above problem, it is an object of the present invention to provide a recording medium which records multilingually written lyrics data for one song program.

It is another object of the present invention to provide a video-song accompaniment apparatus which reproduces the lyrics data of a user-selected language among multilingually written lyrics data recorded on the above recording medium.

Accordingly, to achieve the first object of the present invention, there is provided a recording medium on which accompaniment data of a song program and multilingually written lyrics data corresponding to the accompaniment data are recorded, wherein the lyrics data has a font look-up table which has lyrics data encoded using an index code along with font data corresponding to the index code.

To achieve the second object of the present invention, a video-song accompaniment apparatus according to the present invention comprises: a language selector for generating a lyrics language selection signal for selecting one of multilingually written lyrics data recorded on a recording medium; a reproducing portion for reproducing lyrics data of the selected language corresponding to the lyrics language selection signal generated from the language selector; a font look-up table memory in which a font look-up table is stored among the lyrics data reproduced by the reproducing portion; a lyrics data memory in which lyrics data encoded as an index code is stored among the lyrics data reproduced by the reproducing portion; a font data reading-out portion for reading out font data corresponding to the lyrics data from the font look-up table memory, by referring to the lyrics data stored in the lyrics data memory; and a frame memory for storing font data read out by the font data reading-out portion and providing the stored font data to be periodically read out as a lyrics signal.

BRIEF DESCRIPTION OF THE DRAWINGS

The above objects and advantages of the present invention will become more apparent by describing in detail a preferred embodiment thereof with reference to the attached drawings in which:

FIGS. 3A–3C are views illustrating the contents of the data shown in FIG. 2.

DETAILED DESCRIPTION OF THE INVENTION

Figure 1:
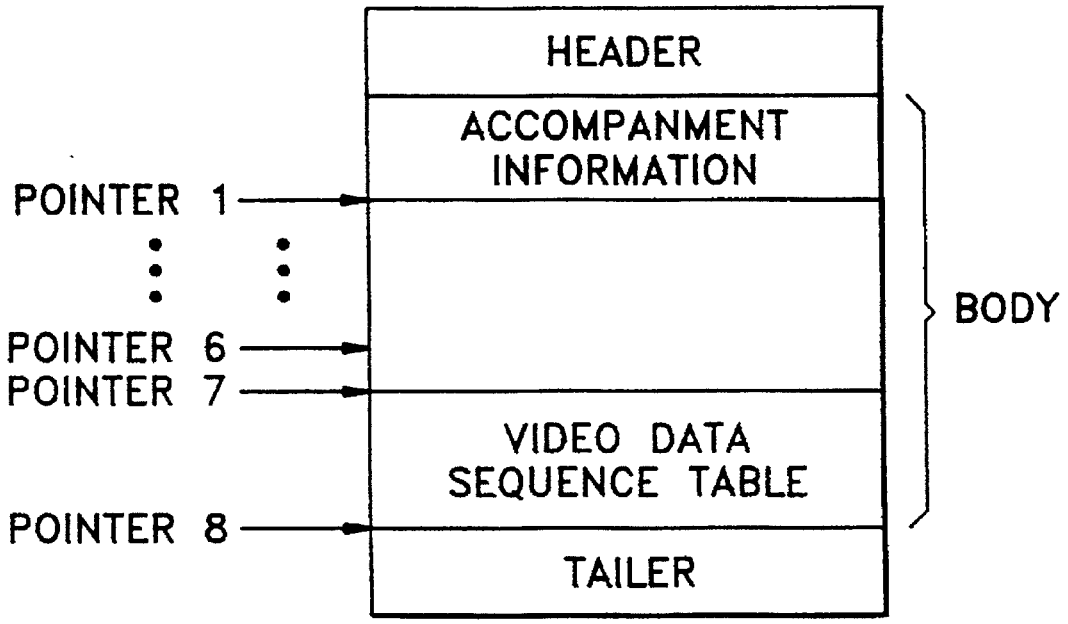
FIG. 1 is a view illustrating a data structure of a song program according to the present invention.

FIG. 1 is a diagram illustrating the data structure of a song program according to the present invention, giving an example of lyrics data written in three languages.

In FIG. 1, the header of a song program has information about a header discrimination code, header size, body size, a pointer address, and total program size. The body is composed of MIDI data for an accompaniment, lyrics data in which a pair of lyrics data, encoded using an index code and a font look-up table, are recorded by language, and a video data sequence table area. A pointer 7 indicates the start address of the video data sequence table, and a pointer 8 indicates the start address of the tailer of the song program.

Figure 2:
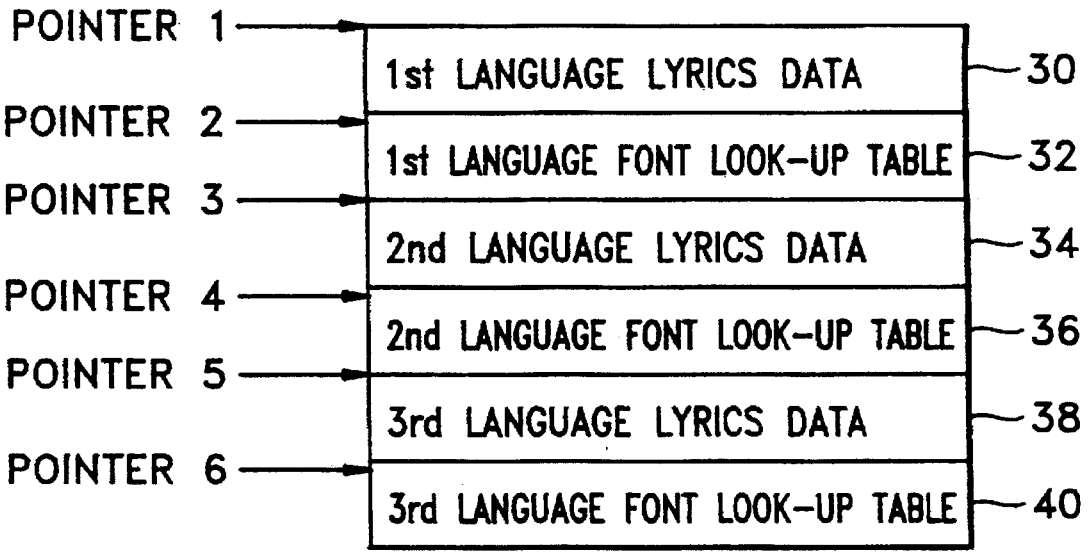
FIG. 2 is a view illustrating in detail a lyrics data recording area of the data structure of a song program as shown in FIG. 1.

FIG. 2 shows a lyrics data area in the data structure shown in FIG. 1. Reference numeral 30 in FIG. 2 indicates a first area in which lyrics data of a first language are recorded, and reference numeral 32 indicates a second area in which a font look-up table that is annexed to the lyrics data recorded in the first area is recorded. Reference numeral 34 indicates a third area in which lyrics data of a second language are recorded, and reference numeral 36 designates a fourth area in which a font look-up table that is annexed to the lyrics data recorded in the third area is recorded. Reference numeral 38 depicts a fifth area in which lyrics data of a third language are recorded, and reference numeral 40 designates a sixth area in which a font look-up table that is annexed to the lyrics data recorded on the fifth area is recorded.

Here, first and second areas 30 and 32, third and fourth areas 34 and 36, and fifth and sixth areas 38 and 40 each constitute closely associated information pairs. The font look-up table written in second area 32 is provided for the restoration of original lyrics data from the lyrics data encoded using an index code written in first area 30. Likewise, the font look-up tables written in the fourth area 36 and sixth area 40 are for the restoration of original lyrics data from the encoded lyrics data using an index code written in the third area 34 and fifth area 38, respectively.

Pointers 1 to 6 indicate the start addresses of first to sixth areas 30 to 40, respectively, and each of the pointers can be set to have a fixed offset value. If a fixed offset value is set between the pointers, it is possible to refer to other areas by one pointer. In this way, it is possible to refer to all the lyrics data and font look-up tables with only one pointer. Under certain circumstances, it can be designed to have a pointer that indicates first area 30 and another pointer that indicates second area 32.

For another format, the leading address of the font look-up table can be indicated by adding data having a fixed offset value to the rear of the pointers that indicate the leading position of first area 30, third area 34, and third area 38. In such a case, it is possible to refer to lyrics data with only three pointers. The number of pointers and the offset value setting relate to a design criteria of a set.

Here, the contents of the "lyrics data encoded by an index code" written in first, third and fifth areas 30, 34 and 38 and the "font look-up table corresponding to the index code" written in second, fourth and sixth areas 32, 36 and 40 will be described with reference to FIGS. 3A–3C.

FIGS. 3A, 3B and 3C show an example of one of the above closely associated information pairs containing English lyrics data. Here, FIG. 3A shows the lyrics data encoded by an index code written in one of the lyrics data areas shown in FIG. 2 (i.e., the lyrics data area for the English language lyrics), and FIG. 3B shows the font look-up table written in the English language font look-up table area. FIG. 3C shows the restored lyrics data according to the above lyrics data and font look-up table.

In FIG. 3C, the number of characters constituting three lines of lyrics is 34, the same as the number of encoded characters by an index code written in the corresponding lyrics data area. However, only thirteen elements are needed to restore the three lines of lyrics, and these thirteen elements constitute the font look-up table written in the corresponding font look-up table area (FIG. 3B). Hence, it can be seen that the memory capacity needed to provide multilingually written lyrics data becomes less. This results from the fact that a prime factor set of the characters appearing in the lyrics data is extracted and only the font data of a bit map pattern corresponding to the extracted prime factor set is recorded.

Ordinarily, the number of characters needed for one song is about 80. Thus, if a character image is expressed as 48×48 bits, a total of 23.04 Kb of memory is allocated in the recording medium to record the font data for one song, and for providing lyrics data to be written in three languages, the memory capacity per song is just 69.12 Kb.

The video-inversion of the lyrics or changing its color according to the procession of the song is called coloring. When the MIDI data is recorded as the accompaniment data, part of the channel information in the MIDI data is used as coloring data. The coloring data should be closely associated with the lyrics data. This is due to the fact that the song procession and coloring procession have to be synchronized.

However, when the lyrics data are expressed in various languages for the same MIDI accompaniment data, as in the present invention, it is difficult to control the coloring of the lyrics data written in each language with the coloring data included in MIDI accompaniment data. That is, the color data for one language does not match that of another because the word sequence and syntax is vastly different from language to language. The present invention solves the above problem by including the color data in the lyrics data itself.

Figure 4:
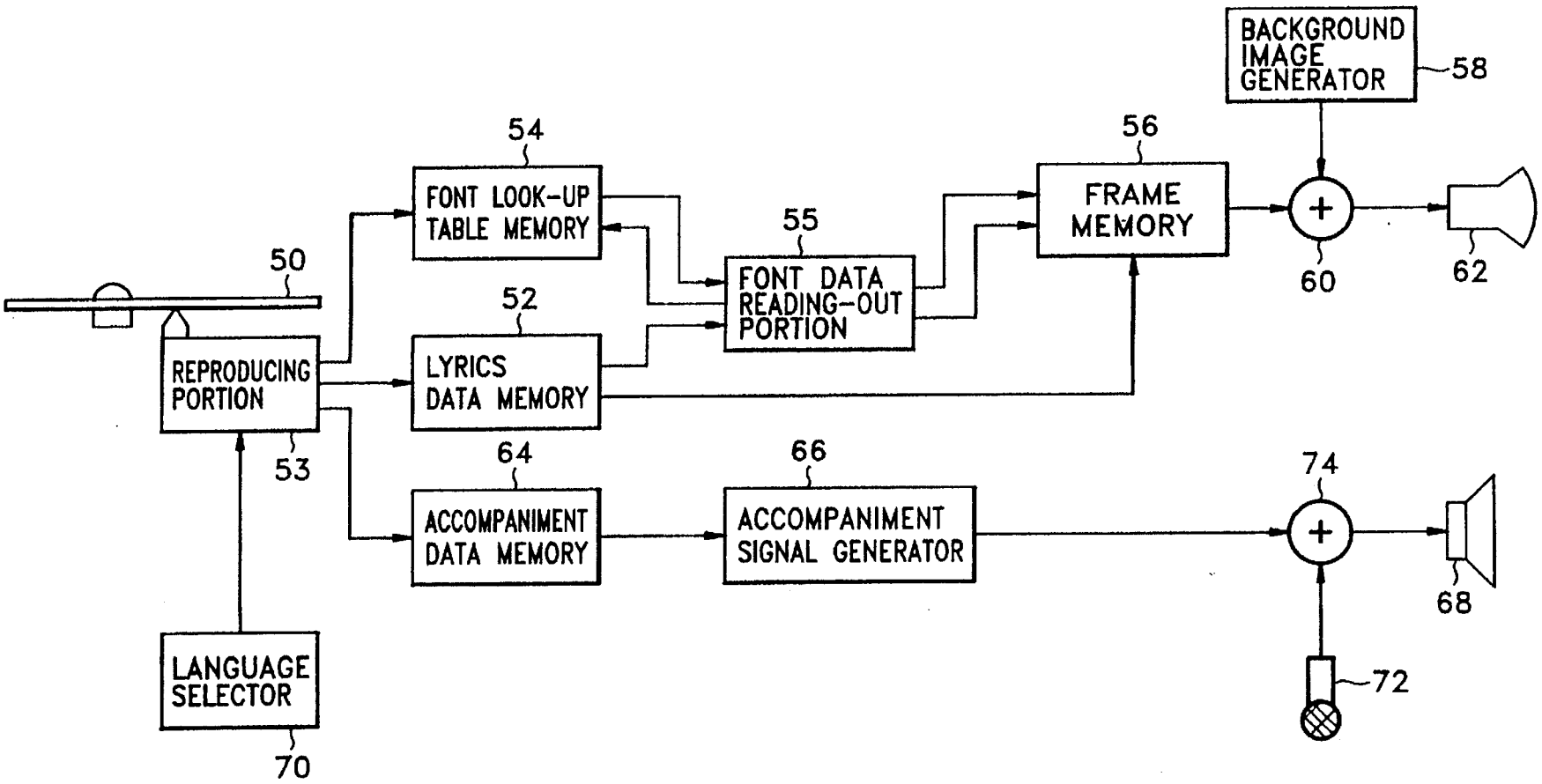
FIG. 4 is a block diagram illustrating a video-song accompaniment apparatus according to the present invention.

FIG. 4 is a block diagram showing a video-song accompaniment apparatus which reproduces lyrics data by language according to language selection information which is input by a user. In FIG. 4, reference numeral 50 designates a compact disk which records multiple sets of accompaniment data, lyrics data encoded by an index code, and a font look-up table that annexes to the lyrics data, according to the method shown in FIGS. 2 and 3. Reference numeral 52 shows a lyrics data memory in which the lyrics data encoded by an index code that is read out from compact disk 50 by reproducing portion 53 is recorded. Reference numeral 54 depicts a font look-up table memory in which a font look-up table read out from compact disk 50 by reproducing portion 53 is recorded. Reference numeral 55 designates a font data reading-out portion which reads out font data from font look-up table memory 54, by referring to the lyrics data encoded by the index code stored in lyrics data memory 52. Reference numeral 56 designates a frame memory in which the font data read-out by font data reading-out portion 55 is stored. The stored data is periodically read out from memory 56 to be provided as a lyrics signal. Reference numeral 60 designates a mixer which mixes the output of background image generator 58 and the lyrics signal generated from frame memory 56 and provides the result to video output device 62. Reference numeral 64 designates an accompaniment data memory in which accompaniment data read out by reproducing portion 53 is stored. Reference numeral 66 designates an accompaniment signal generator which reads out the accompaniment data stored in accompaniment data memory 64 and generates an accompaniment signal corresponding to the accompaniment data, to be provided to speaker 68. Language selector 70 generates a lyrics data selection signal for determining lyrics data to be reproduced among the lyrics data (written in multiple languages) according to a user's manipulation.

In the operation of the video-song accompaniment apparatus shown in FIG. 4, reproducing portion 53 reproduces the lyrics data corresponding to the selected language among the lyrics data written in each language on compact disk 50, by referring to the language signal provided from language selector 70. Among the lyrics data reproduced by reproducing portion 53, the lyrics data is stored in lyrics data memory 52, and the font look-up table is stored in font look-up table memory 54. (Although simplified for the convenience of explanation, the reproducing portion 53 of FIG. 4 includes a pickup device, a servo device, a song program selection input portion, etc.) Font look-up table memory 54 stores a font look-up table read out by reproducing portion 53. The number of characters needed for a song is usually about 80, so that font look-up table memory 54 shown in FIG. 4 needs a memory capacity of 23.04 Kb. The lyrics data read from compact disk 50 includes address information and an index code. Among them, the index code is provided to font data reading-out portion 55, and the address information is provided to frame memory 56. Font data reading-out portion 55 reads out successively lyrics data stored in lyrics data memory 52, provides the index code to font look-up table 54, and provides the address information to frame memory 56. Font look-up table memory 54 outputs the font data corresponding to the input index code to frame memory 56. Frame memory 56 receives the address information and the font data, and locates the font data on a designated position according to the address information. The contents stored in frame memory 56 are read out periodically in synchronization with the period of a video signal generated from background image generator 58. Language selector 70 may be composed of a set of multiple slide switches. Each slide switch generates a binary signal. A user generates a 2-bit combination signal by turning on or off each slide switch. Reproducing portion 53 selects or reproduces the lyrics data by language written on compact disk 50 by referring to 2-bit digital signal generated from language selector 70. In FIG. 4, reference numeral 72 designates a microphone, and reference numeral 74 designates an audio mixer for mixing an accompaniment signal generated from accompaniment signal generator 66 with a vocal signal input through microphone 72, and outputs the result to speaker 68.

As described above, a recording medium according to the present invention provides multilingually written lyrics data using a single recording medium.

A video-song accompaniment apparatus according to the present invention reproduces appropriate lyrics data, according to the user's taste or to the language of a given country.

What is claimed is:

1. A recording medium for storing data for access by a video-song accompaniment apparatus, comprising: a data structure stored on said recording medium, in which accompaniment data of a song program and multilingually written lyrics data corresponding to the accompaniment data are recorded, the lyrics data being encoded using an index code and a font look-up table corresponding to the index code.

2. A video-song accompaniment apparatus comprising:

a language selector for generating a lyrics language selection signal that selects one of multilingually written lyrics data recorded on a recording medium;

a reproducing portion for reproducing lyrics data of the selected language corresponding to the lyrics language selection signal generated from said language selector;

a font look-up table memory in which a font look-up table is stored among the lyrics data reproduced by said reproducing portion;

a lyrics data memory in which lyrics data encoded as an index code is stored among the lyrics data reproduced by said reproducing portion;

a font data reading-out portion for reading out font data corresponding to the lyrics data, from said font look-up table memory, by referring to the lyrics data written in said lyrics data memory; and a frame memory for storing font data read out by said font data reading-out portion and periodically reading out the stored font data to provide the stored font data as a lyrics signal.

* * * * *